US007690062B2

(12) United States Patent
Pinkowski et al.

(10) Patent No.: US 7,690,062 B2
(45) Date of Patent: Apr. 6, 2010

(54) METHOD FOR CLEANING A STEAM GENERATOR

(75) Inventors: Robert J. Pinkowski, Baroda, MI (US); Christoph Herkle, Schwäbisch Gmünd (DE); Alvaro Vallejo Noriega, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/848,540

(22) Filed: Aug. 31, 2007

(65) Prior Publication Data

US 2009/0056762 A1 Mar. 5, 2009

(51) Int. Cl.
*D06F 35/00* (2006.01)
*B08B 3/00* (2006.01)

(52) U.S. Cl. ..... 8/158; 68/5 R; 134/22.1; 134/31; 134/42

(58) Field of Classification Search ..... 134/22.1, 134/30, 31, 42, 105, 106, 107, 166 C; 8/149.1, 8/149.2, 149.3; 68/5 R; 122/447, 446, 14.1
See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 647,112 | A | 4/1900 | Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |
| 2,966,052 | A | 12/1960 | Syles |
| 3,035,145 | A | 5/1962 | Rudolph |
| 3,060,713 | A | 10/1962 | Burkall |
| 3,223,108 | A | 12/1965 | Martz, Jr. |
| 3,347,066 | A | 10/1967 | Klausner |
| 3,712,089 | A | 1/1973 | Toth |
| 3,801,077 | A | 4/1974 | Pearson |

(Continued)

FOREIGN PATENT DOCUMENTS

| | | | |
|---|---|---|---|
| CA | 1330526 | C | 7/1994 |

(Continued)

OTHER PUBLICATIONS

V-ZUG LTD Washing Machine Adora SL; User Manual; V-ZUG AG, CH-6301 Zug, 2004; V-ZUG LTD Industriestrasse 66, 6301 Zug, Tel. 041 767 67 67.

*Primary Examiner*—Michael Cleveland
*Assistant Examiner*—Nicole Blan
(74) *Attorney, Agent, or Firm*—Clifton G. Green; McGarry Bair P.C.

(57) ABSTRACT

A method for cleaning a steam generator may include supplying water to the steam generator and boiling the water in the steam generator to separate and expel at least some deposits in the steam generator.

25 Claims, 7 Drawing Sheets

U.S. PATENT DOCUMENTS

| | | | | |
|---|---|---|---|---|
| 3,869,815 | A | 3/1975 | Bullock | |
| 3,890,987 | A | 6/1975 | Marcussen et al. | |
| 3,935,719 | A | 2/1976 | Henderson | |
| 4,020,396 | A | 4/1977 | Gambale et al. | |
| 4,034,583 | A | 7/1977 | Miessler | |
| 4,045,174 | A | 8/1977 | Fuhring et al. | |
| 4,108,000 | A | 8/1978 | Norris | |
| 4,177,928 | A | 12/1979 | Bergkvist | |
| 4,207,683 | A | 6/1980 | Horton | |
| 4,214,148 | A | 7/1980 | Fleischhauer | |
| 4,332,047 | A | 6/1982 | Kuttelwesch | |
| 4,386,509 | A | 6/1983 | Kuttelwesch | |
| 4,432,111 | A | 2/1984 | Hoffmann et al. | |
| 4,489,574 | A | 12/1984 | Spendel | |
| 4,646,630 | A | 3/1987 | McCoy et al. | |
| 4,761,305 | A | 8/1988 | Ochiai | |
| 4,777,682 | A | 10/1988 | Dreher et al. | |
| 4,784,666 | A | 11/1988 | Brenner et al. | |
| 4,809,597 | A | 3/1989 | Lin | |
| 4,879,887 | A | 11/1989 | Kagi et al. | |
| 4,920,668 | A | 5/1990 | Henneberger et al. | |
| 4,987,627 | A | 1/1991 | Cur et al. | |
| 4,991,545 | A | 2/1991 | Rabe et al. | |
| 5,032,186 | A | 7/1991 | Childers et al. | |
| 5,050,259 | A | 9/1991 | Tsubaki et al. | |
| 5,052,344 | A | 10/1991 | Kosugi et al. | |
| 5,058,194 | A | 10/1991 | Violi | |
| 5,063,609 | A | 11/1991 | Lorimer | |
| 5,107,606 | A | 4/1992 | Tsubaki et al. | |
| 5,146,693 | A | 9/1992 | Dottor et al. | |
| 5,152,252 | A | 10/1992 | Bolton et al. | |
| 5,154,197 | A * | 10/1992 | Auld et al. | 134/1 |
| 5,172,654 | A | 12/1992 | Christiansen | |
| 5,172,888 | A * | 12/1992 | Ezekoye | 251/367 |
| 5,212,969 | A | 5/1993 | Tsubaki et al. | |
| 5,219,370 | A | 6/1993 | Farrington et al. | |
| 5,219,371 | A | 6/1993 | Shim et al. | |
| 5,279,676 | A | 1/1994 | Oslin et al. | |
| 5,291,758 | A | 3/1994 | Lee | |
| 5,293,761 | A | 3/1994 | Jang | |
| 5,315,727 | A | 5/1994 | Lee | |
| 5,345,637 | A | 9/1994 | Pastryk et al. | |
| 5,570,626 | A | 11/1996 | Vos | |
| 5,619,983 | A | 4/1997 | Smith | |
| 5,727,402 | A | 3/1998 | Wada | |
| 5,732,664 | A | 3/1998 | Badeaux, Jr. | |
| 5,743,034 | A | 4/1998 | Debourg et al. | |
| 5,758,377 | A | 6/1998 | Cimetta et al. | |
| 5,768,730 | A | 6/1998 | Matsumoto et al. | |
| 5,815,637 | A | 9/1998 | Allen et al. | |
| 6,029,300 | A | 2/2000 | Kawaguchi et al. | |
| 6,067,403 | A | 5/2000 | Morgandi | |
| 6,094,523 | A | 7/2000 | Zelina et al. | |
| 6,122,849 | A | 9/2000 | Kida et al. | |
| 6,161,306 | A | 12/2000 | Clodic | |
| 6,178,671 | B1 | 1/2001 | Zwanenburg et al. | |
| 6,295,691 | B1 | 10/2001 | Chen | |
| 6,434,857 | B1 | 8/2002 | Anderson et al. | |
| 6,451,066 | B2 | 9/2002 | Estes et al. | |
| 6,585,781 | B1 | 7/2003 | Roseen | |
| 6,622,529 | B1 | 9/2003 | Crane | |
| 6,647,931 | B1 | 11/2003 | Morgandi et al. | |
| 6,691,536 | B2 | 2/2004 | Severns et al. | |
| 6,772,751 | B2 | 8/2004 | Deuringer et al. | |
| 6,789,404 | B2 | 9/2004 | Kim et al. | |
| 6,874,191 | B2 | 4/2005 | Kim et al. | |
| 6,889,399 | B2 | 5/2005 | Steiner et al. | |
| 7,021,087 | B2 | 4/2006 | France et al. | |
| 7,096,828 | B2 * | 8/2006 | Tippmann | 122/447 |
| 7,290,412 | B2 | 11/2007 | Yang et al. | |
| 7,325,330 | B2 | 2/2008 | Kim et al. | |
| 7,404,304 | B2 | 7/2008 | Yang et al. | |
| 7,421,752 | B2 | 9/2008 | Donadon et al. | |
| 7,490,491 | B2 | 2/2009 | Yang et al. | |
| 7,490,493 | B2 | 2/2009 | Kim et al. | |
| 7,520,146 | B2 | 4/2009 | Kim et al. | |
| 2001/0032599 | A1 | 10/2001 | Fischer et al. | |
| 2003/0215226 | A1 | 11/2003 | Nomura et al. | |
| 2004/0163184 | A1 | 8/2004 | Waldron et al. | |
| 2004/0187527 | A1 | 9/2004 | Kim et al. | |
| 2004/0187529 | A1 | 9/2004 | Kim et al. | |
| 2004/0200093 | A1 | 10/2004 | Wunderlin et al. | |
| 2004/0206480 | A1 | 10/2004 | Maydanik et al. | |
| 2004/0237603 | A1 | 12/2004 | Kim et al. | |
| 2004/0244432 | A1 | 12/2004 | Kim et al. | |
| 2004/0244438 | A1 | 12/2004 | North | |
| 2004/0255391 | A1 | 12/2004 | Kim et al. | |
| 2005/0028297 | A1 | 2/2005 | Kim et al. | |
| 2005/0034248 | A1 | 2/2005 | Oh et al. | |
| 2005/0034249 | A1 | 2/2005 | Oh et al. | |
| 2005/0034250 | A1 | 2/2005 | Oh et al. | |
| 2005/0034487 | A1 | 2/2005 | Oh et al. | |
| 2005/0034488 | A1 | 2/2005 | Oh et al. | |
| 2005/0034489 | A1 | 2/2005 | Oh et al. | |
| 2005/0034490 | A1 | 2/2005 | Oh et al. | |
| 2005/0050644 | A1 | 3/2005 | Severns et al. | |
| 2005/0072382 | A1 | 4/2005 | Tippmann | |
| 2005/0072383 | A1 | 4/2005 | Powell et al. | |
| 2005/0092035 | A1 | 5/2005 | Shin et al. | |
| 2005/0132503 | A1 | 6/2005 | Yang et al. | |
| 2005/0132504 | A1 | 6/2005 | Yang et al. | |
| 2005/0132756 | A1 | 6/2005 | Yang et al. | |
| 2005/0144734 | A1 | 7/2005 | Yang et al. | |
| 2005/0144735 | A1 | 7/2005 | Yang et al. | |
| 2005/0220672 | A1 | 10/2005 | Takahashi et al. | |
| 2005/0223503 | A1 | 10/2005 | Hong et al. | |
| 2005/0223504 | A1 | 10/2005 | Lee et al. | |
| 2005/0252250 | A1 | 11/2005 | Oh et al. | |
| 2005/0262644 | A1 | 12/2005 | Oak et al. | |
| 2006/0000242 | A1 | 1/2006 | Yang et al. | |
| 2006/0001612 | A1 | 1/2006 | Kim | |
| 2006/0005581 | A1 | 1/2006 | Banba | |
| 2006/0010613 | A1 | 1/2006 | Jeon et al. | |
| 2006/0010727 | A1 | 1/2006 | Fung | |
| 2006/0010937 | A1 | 1/2006 | Kim et al. | |
| 2006/0016020 | A1 | 1/2006 | Park | |
| 2006/0090524 | A1 | 5/2006 | Jeon et al. | |
| 2006/0096333 | A1 | 5/2006 | Park et al. | |
| 2006/0101586 | A1 | 5/2006 | Park et al. | |
| 2006/0101588 | A1 | 5/2006 | Park et al. | |
| 2006/0101867 | A1 | 5/2006 | Kleker | |
| 2006/0107468 | A1 | 5/2006 | Urbanet et al. | |
| 2006/0112585 | A1 | 6/2006 | Choi et al. | |
| 2006/0117596 | A1 | 6/2006 | Kim et al. | |
| 2006/0130354 | A1 | 6/2006 | Choi et al. | |
| 2006/0137105 | A1 | 6/2006 | Hong et al. | |
| 2006/0137107 | A1 | 6/2006 | Lee et al. | |
| 2006/0150689 | A1 | 7/2006 | Kim et al. | |
| 2006/0151005 | A1 | 7/2006 | Kim et al. | |
| 2006/0151009 | A1 | 7/2006 | Kim et al. | |
| 2006/0191077 | A1 | 8/2006 | Oh et al. | |
| 2006/0191078 | A1 | 8/2006 | Kim et al. | |
| 2006/0277690 | A1 | 12/2006 | Pyo et al. | |
| 2007/0006484 | A1 | 1/2007 | Moschuetz et al. | |
| 2007/0028398 | A1 | 2/2007 | Kwon et al. | |
| 2007/0101773 | A1 | 5/2007 | Park et al. | |
| 2007/0107472 | A1 | 5/2007 | Kim et al. | |
| 2007/0107884 | A1 | 5/2007 | Sirkar et al. | |
| 2007/0125133 | A1 | 6/2007 | Oh et al. | |
| 2007/0130697 | A1 | 6/2007 | Oh et al. | |
| 2007/0136956 | A1 | 6/2007 | Kim et al. | |
| 2007/0137262 | A1 | 6/2007 | Kim et al. | |
| 2007/0169279 | A1 * | 7/2007 | Park et al. | 8/149.3 |
| 2007/0169280 | A1 | 7/2007 | Kim et al. | |

| | | | |
|---|---|---|---|
| 2007/0169282 | A1 | 7/2007 | Kim |
| 2007/0169521 | A1 | 7/2007 | Kim et al. |
| 2007/0180628 | A1 | 8/2007 | Ahn |
| 2007/0186591 | A1 | 8/2007 | Kim et al. |
| 2007/0186592 | A1 | 8/2007 | Kim et al. |
| 2007/0186593 | A1 | 8/2007 | Ahn |
| 2007/0199353 | A1 | 8/2007 | Woo et al. |
| 2007/0240458 | A1 | 10/2007 | Kim et al. |
| 2007/0283505 | A1 | 12/2007 | Wong et al. |
| 2007/0283508 | A1 | 12/2007 | Wong et al. |
| 2007/0283728 | A1 | 12/2007 | Wong et al. |
| 2008/0006063 | A1 | 1/2008 | Ahn et al. |
| 2008/0019864 | A1 | 1/2008 | Savage et al. |
| 2008/0028801 | A1 | 2/2008 | Czyzewski et al. |
| 2008/0115740 | A1 | 5/2008 | You |

FOREIGN PATENT DOCUMENTS

| | | | |
|---|---|---|---|
| CN | 1664222 | A | 9/2005 |
| CN | 1962988 | | 5/2007 |
| CN | 1962998 | A | 5/2007 |
| CN | 1965123 | A | 5/2007 |
| CN | 101003939 | A | 7/2007 |
| CN | 101008148 | A | 8/2007 |
| CN | 101024915 | A | 8/2007 |
| DE | 12203 | | 2/1881 |
| DE | 42920 | | 4/1888 |
| DE | 69929 | | 8/1893 |
| DE | 132104 | | 7/1902 |
| DE | 176355 | | 10/1906 |
| DE | 243328 | | 2/1912 |
| DE | 283533 | | 4/1915 |
| DE | 317887 | | 1/1920 |
| DE | 427025 | | 3/1926 |
| DE | 435088 | | 10/1926 |
| DE | 479594 | | 7/1929 |
| DE | 668963 | | 12/1938 |
| DE | 853433 | | 10/1952 |
| DE | 894685 | | 10/1953 |
| DE | 1847016 | | 2/1962 |
| DE | 1873622 | | 6/1963 |
| DE | 2202345 | | 8/1973 |
| DE | 2226373 | | 12/1973 |
| DE | 2245532 | | 3/1974 |
| DE | 7340082 | | 5/1975 |
| DE | 2410107 | | 9/1975 |
| DE | 2533759 | | 2/1977 |
| DE | 3103529 | A1 | 8/1982 |
| DE | 3139466 | A1 | 4/1983 |
| DE | 3408136 | | 9/1985 |
| DE | 3501008 | A1 | 7/1986 |
| DE | 3627988 | | 4/1987 |
| DE | 8703344 | | 8/1988 |
| DE | 4116673 | A1 | 11/1992 |
| DE | 4225847 | | 2/1994 |
| DE | 4413213 | | 10/1995 |
| DE | 4443338 | | 6/1996 |
| DE | 29707168 | | 7/1997 |
| DE | 19730422 | A1 | 1/1999 |
| DE | 19736794 | A1 | 2/1999 |
| DE | 19742282 | | 2/1999 |
| DE | 19743508 | | 4/1999 |
| DE | 19751028 | | 5/1999 |
| DE | 19903951 | | 8/2000 |
| DE | 10028944 | | 12/2001 |
| DE | 10035904 | | 1/2002 |
| DE | 10039904 | | 2/2002 |
| DE | 10043165 | | 2/2002 |
| DE | 10312163 | | 11/2003 |
| DE | 102005051721 | A1 | 5/2007 |
| DE | 102007023020 | B3 | 5/2008 |
| EP | 0043122 | | 1/1982 |
| EP | 0132884 | | 2/1985 |
| EP | 0135484 | A2 | 3/1985 |
| EP | 0217981 | | 4/1987 |
| EP | 0222264 | | 5/1987 |
| EP | 0280782 | | 9/1988 |
| EP | 0284554 | | 9/1988 |
| EP | 0287990 | | 10/1988 |
| EP | 0302125 | | 8/1989 |
| EP | 363708 | | 4/1990 |
| EP | 0383327 | | 8/1990 |
| EP | 0404253 | A1 | 12/1990 |
| EP | 0511525 | | 11/1992 |
| EP | 0574341 | A1 | 12/1993 |
| EP | 0582092 | A1 | 2/1994 |
| EP | 0638684 | A1 | 2/1995 |
| EP | 0672377 | A1 | 9/1995 |
| EP | 0726349 | A2 | 8/1996 |
| EP | 0768059 | | 4/1997 |
| EP | 0785303 | A1 | 7/1997 |
| EP | 0808936 | | 11/1997 |
| EP | 0821096 | A1 | 1/1998 |
| EP | 0839943 | A1 | 5/1998 |
| EP | 0816550 | | 7/1998 |
| EP | 1163387 | | 12/2001 |
| EP | 1275767 | | 1/2003 |
| EP | 1351016 | | 10/2003 |
| EP | 1411163 | | 4/2004 |
| EP | 1437547 | | 7/2004 |
| EP | 1441059 | | 7/2004 |
| EP | 1441175 | | 7/2004 |
| EP | 1464750 | | 10/2004 |
| EP | 1464751 | | 10/2004 |
| EP | 1469120 | | 10/2004 |
| EP | 1505193 | A2 | 2/2005 |
| EP | 1507028 | | 2/2005 |
| EP | 1507029 | | 2/2005 |
| EP | 1507030 | | 2/2005 |
| EP | 1507031 | | 2/2005 |
| EP | 1507032 | | 2/2005 |
| EP | 1507033 | | 2/2005 |
| EP | 1529875 | | 5/2005 |
| EP | 1544345 | | 6/2005 |
| EP | 1548175 | | 6/2005 |
| EP | 1550760 | | 7/2005 |
| EP | 1555338 | | 7/2005 |
| EP | 1555340 | | 7/2005 |
| EP | 1561853 | | 8/2005 |
| EP | 1584728 | | 10/2005 |
| EP | 1619284 | A1 | 1/2006 |
| EP | 1655408 | A1 | 5/2006 |
| EP | 1659205 | A2 | 5/2006 |
| EP | 1681384 | A1 | 7/2006 |
| EP | 1696066 | A2 | 8/2006 |
| EP | 1731840 | | 12/2006 |
| EP | 1746197 | A2 | 1/2007 |
| EP | 1783262 | A2 | 5/2007 |
| EP | 1555339 | | 8/2007 |
| EP | 1813704 | A1 | 8/2007 |
| EP | 1813709 | A2 | 8/2007 |
| EP | 1865099 | A1 | 12/2007 |
| EP | 1865101 | A1 | 12/2007 |
| EP | 1889966 | A2 | 2/2008 |
| EP | 1936023 | A1 | 6/2008 |
| FR | 2306400 | | 10/1976 |
| FR | 2525645 | A1 | 10/1983 |
| FR | 2581442 | | 11/1986 |
| FR | 2688807 | A1 | 9/1993 |
| GB | 21286 | | 8/1898 |
| GB | 10423 | | 11/1909 |
| GB | 21024 | | 2/1910 |
| GB | 191010567 | A | 4/1911 |
| GB | 191010792 | A | 4/1911 |
| GB | 191022943 | A | 8/1911 |
| GB | 191024005 | A | 10/1911 |

| | | | |
|---|---|---|---|
| GB | 191103554 | A | 12/1911 |
| GB | 102466 | A | 12/1916 |
| GB | 285384 | A | 11/1928 |
| GB | 397236 | | 8/1933 |
| GB | 514440 | A | 11/1939 |
| GB | 685813 | | 1/1953 |
| GB | 799788 | | 8/1958 |
| GB | 835250 | | 5/1960 |
| GB | 881083 | | 11/1961 |
| GB | 889500 | A | 2/1962 |
| GB | 1155268 | A | 6/1969 |
| GB | 1331623 | | 9/1973 |
| GB | 1352955 | | 5/1974 |
| GB | 1366852 | | 9/1974 |
| GB | 2219603 | A | 12/1989 |
| GB | 2309071 | A | 7/1997 |
| GB | 2348213 | | 9/2000 |
| JP | 35021275 | | 8/1950 |
| JP | 36023044 | | 9/1960 |
| JP | 36000067 | | 7/1961 |
| JP | 52146973 | | 12/1977 |
| JP | 54068072 | A | 5/1979 |
| JP | 57094480 | | 6/1982 |
| JP | 57032858 | | 7/1982 |
| JP | 60138399 | | 7/1985 |
| JP | 61128995 | | 6/1986 |
| JP | 62066891 | | 3/1987 |
| JP | 2049700 | | 2/1990 |
| JP | 02161997 | | 6/1990 |
| JP | 02026465 | | 7/1990 |
| JP | 02198595 | | 8/1990 |
| JP | 2239894 | | 9/1990 |
| JP | 2242088 | A | 9/1990 |
| JP | 02267402 | | 11/1990 |
| JP | 03025748 | | 6/1991 |
| JP | 3137401 | A | 6/1991 |
| JP | 04158896 | | 6/1992 |
| JP | 4158896 | A | 6/1992 |
| JP | 05023493 | | 2/1993 |
| JP | 05115672 | A | 5/1993 |
| JP | 05146583 | | 6/1993 |
| JP | 05269294 | | 10/1993 |
| JP | 5346485 | A | 12/1993 |
| JP | 06123360 | | 5/1994 |
| JP | 08261689 | | 10/1996 |
| JP | 9133305 | A | 5/1997 |
| JP | 1147488 | | 2/1999 |
| JP | 11164979 | | 6/1999 |
| JP | 11164980 | | 6/1999 |
| JP | 11226290 | | 8/1999 |
| JP | 2000176192 | | 6/2000 |
| JP | 2003019382 | | 1/2003 |
| JP | 2003093775 | | 4/2003 |
| JP | 2003311068 | | 11/2003 |
| JP | 2003311084 | | 11/2003 |
| JP | 2003320324 | | 11/2003 |
| JP | 2003326077 | | 11/2003 |
| JP | 2004061011 | A | 2/2004 |
| JP | 2004121666 | | 4/2004 |
| JP | 2004167131 | | 6/2004 |
| JP | 2004298614 | | 10/2004 |
| JP | 2004298616 | | 10/2004 |
| JP | 2004313793 | | 11/2004 |
| JP | 2005058740 | | 3/2005 |
| JP | 2005058741 | | 3/2005 |
| JP | 2005177440 | | 7/2005 |
| JP | 2005177445 | | 7/2005 |
| JP | 2005177450 | | 7/2005 |
| JP | 2005192997 | | 7/2005 |
| JP | 2005193003 | | 7/2005 |
| JP | 2006109886 | | 4/2006 |
| JP | 2006130295 | | 5/2006 |
| KR | 9319820 | | 9/1993 |
| KR | 1019950018856 | | 7/1995 |
| KR | 1019970011098 | | 3/1997 |
| KR | 1019970070295 | | 11/1997 |
| KR | 2019970039170 | | 7/1998 |
| KR | 200128631 | | 8/1998 |
| KR | 100146947 | | 10/1998 |
| KR | 20010015043 | | 2/2001 |
| KR | 10220010010111 | | 2/2001 |
| KR | 20040085509 | A | 10/2004 |
| KR | 20050017481 | A | 2/2005 |
| KR | 20060031165 | | 4/2006 |
| WO | 9214954 | | 9/1992 |
| WO | 9307798 | A1 | 4/1993 |
| WO | 9319237 | A1 | 9/1993 |
| WO | 9715709 | | 5/1997 |
| WO | 9803175 | | 1/1998 |
| WO | 0111134 | | 2/2001 |
| WO | 0174129 | A2 | 10/2001 |
| WO | 03012185 | | 2/2003 |
| WO | 03012185 | A2 | 2/2003 |
| WO | 03057966 | | 7/2003 |
| WO | 2004059070 | | 7/2004 |
| WO | 2004091359 | A2 | 10/2004 |
| WO | 2005001189 | A1 | 1/2005 |
| WO | 2005018837 | A1 | 3/2005 |
| WO | 2005115095 | | 12/2005 |
| WO | 2006001612 | | 1/2006 |
| WO | 2006009364 | A1 | 1/2006 |
| WO | 2006070317 | A1 | 7/2006 |
| WO | 2006090973 | | 8/2006 |
| WO | 2006091054 | | 8/2006 |
| WO | 2006091057 | A1 | 8/2006 |
| WO | 2006098571 | | 9/2006 |
| WO | 2006098572 | | 9/2006 |
| WO | 2006098573 | | 9/2006 |
| WO | 2006101304 | | 9/2006 |
| WO | 2006101312 | | 9/2006 |
| WO | 2006101336 | | 9/2006 |
| WO | 2006101345 | | 9/2006 |
| WO | 2006101358 | | 9/2006 |
| WO | 2006101360 | | 9/2006 |
| WO | 2006101361 | | 9/2006 |
| WO | 2006101362 | | 9/2006 |
| WO | 2006101363 | | 9/2006 |
| WO | 2006101365 | | 9/2006 |
| WO | 2006101372 | | 9/2006 |
| WO | 2006101376 | | 9/2006 |
| WO | 2006101377 | | 9/2006 |
| WO | 2006104310 | | 10/2006 |
| WO | 2006112611 | | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |
| WO | 2006129916 | A1 | 12/2006 |
| WO | 2007004785 | A1 | 1/2007 |
| WO | 2007007241 | A1 | 1/2007 |
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007055475 | A1 | 5/2007 |
| WO | 2007055510 | A1 | 5/2007 |

| | | | |
|---|---|---|---|
| WO | 2007058477 | A1 | 5/2007 |
| WO | 2007073012 | A1 | 6/2007 |
| WO | 2007073013 | A1 | 6/2007 |
| WO | 2007081069 | A1 | 7/2007 |
| WO | 2007086672 | A1 | 8/2007 |
| WO | 2007116255 | A1 | 10/2007 |
| WO | 2007145448 | A2 | 12/2007 |
| WO | 2008004801 | A2 | 1/2008 |

* cited by examiner

METHOD FOR CLEANING A STEAM GENERATOR

BACKGROUND OF THE INVENTION

1. Field of the Invention

The invention relates to a method of cleaning a steam generator.

2. Description of the Related Art

Some fabric treatment appliances, such as a washing machine, a clothes dryer, and a fabric refreshing or revitalizing machine, use steam generators for various reasons. The steam from the steam generator can be used to, for example, heat water, heat a load of fabric items and any water absorbed by the fabric items, dewrinkle fabric items, remove odors from fabric items, sanitize the fabric items, and sanitize components of the fabric treatment appliance.

A common problem associated with steam generators involves the formation of deposits, such as scale and sludge, within the steam generation chamber. Water supplies for many households may contain dissolved substances, such as calcium and magnesium, which can lead to the formation of deposits in the steam generation chamber when the water is heated. Scale and sludge are, respectively, hard and soft deposits; in some conditions, the hard scale tends to deposit on the inner walls of the structure forming the steam generation chamber, and the soft sludge can settle to the bottom of the steam generator. Formation of scale and sludge can detrimentally affect heat transfer and fluid flow and can lead to a reduced lifespan of the heater or steam generator.

SUMMARY OF THE INVENTION

A method for cleaning deposits from a steam generator having an inlet for receiving water and an outlet for expelling steam comprises supplying a volume of water to the steam generator greater than an operational volume of water for steam generation by boiling the volume of water in the steam generator to separate at least some of the deposits from the steam generator and expelling at least some of the separated deposits along with steam and water through the outlet.

DESCRIPTION OF EMBODIMENTS OF THE INVENTION

Figure 1:
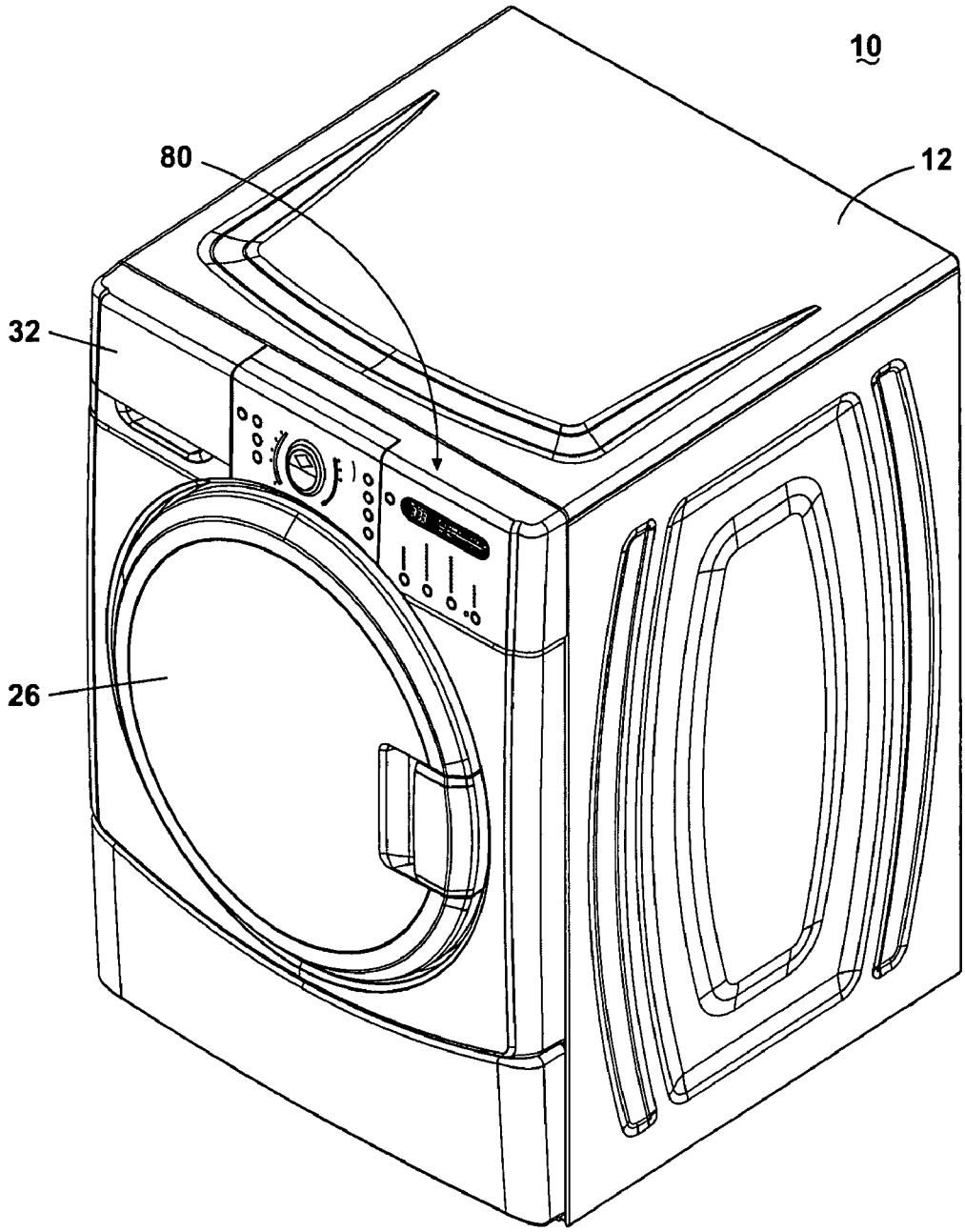
FIG. 1 is a perspective view of an exemplary fabric treatment appliance in the form of a washing machine according to one embodiment of the invention.

Referring now to the figures, FIG. 1 is a schematic view of an exemplary fabric treatment appliance in the form of a washing machine 10 according to one embodiment of the invention. The fabric treatment appliance may be any machine that treats fabrics, and examples of the fabric treatment appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the invention will be described with respect to a washing machine with the fabric being a clothes load, with it being understood that the invention may be adapted for use with any type of fabric treatment appliance for treating fabric and to other appliances, such as dishwashers, irons, and cooking appliances, including ovens, food steamers, and microwave ovens, employing a steam generator.

Figure 2:
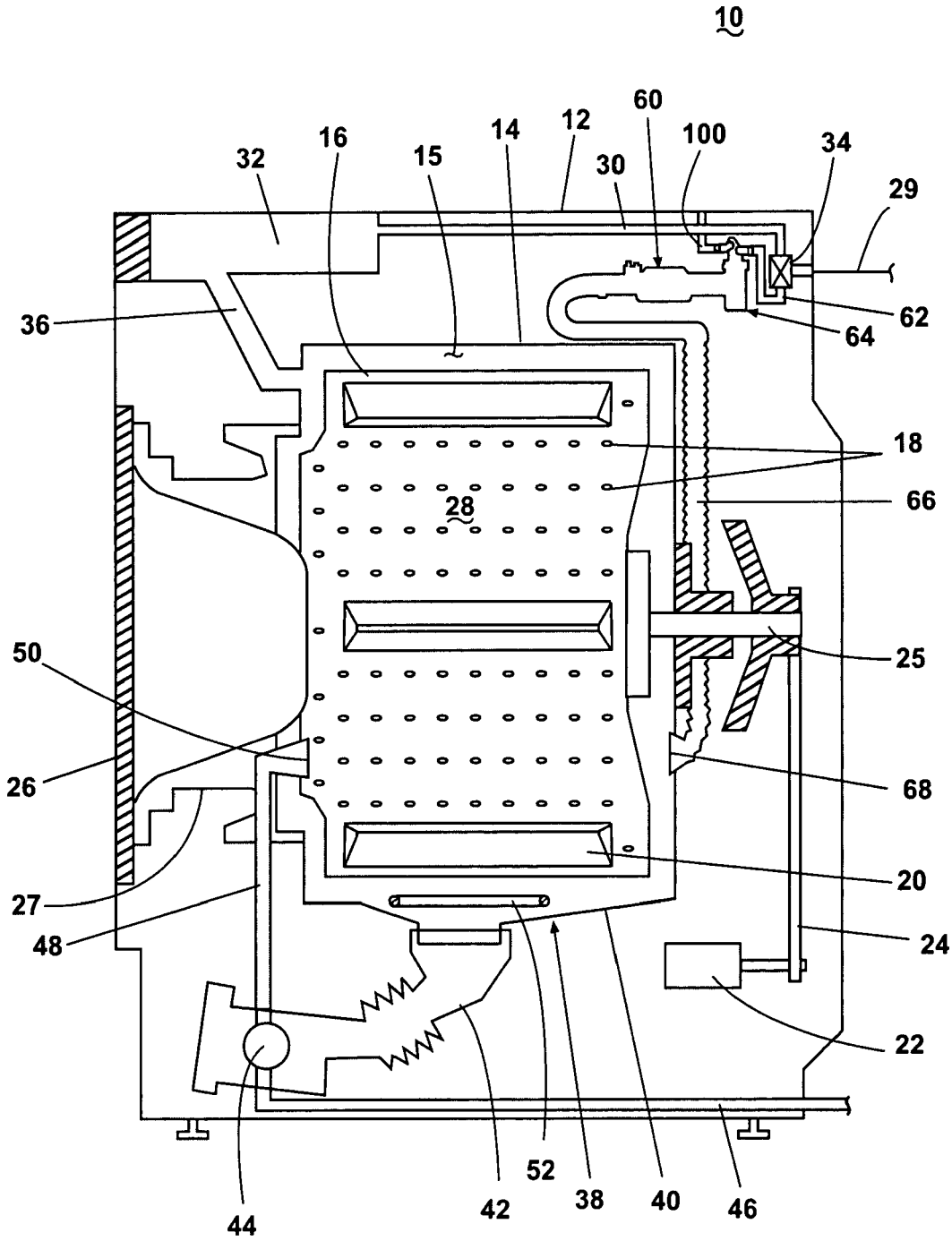
FIG. 2 is a schematic view of the fabric treatment appliance of FIG. 1.

FIG. 2 provides a schematic view of the fabric treatment appliance of FIG. 1. The washing machine 10 of the illustrated embodiment may include a cabinet 12 that houses a stationary tub 14, which defines an interior chamber 15. A rotatable drum 16 mounted within the interior chamber 15 of the tub 14 may include a plurality of perforations 18, and liquid may flow between the tub 14 and the drum 16 through the perforations 18. The drum 16 may further include a plurality of baffles 20 disposed on an inner surface of the drum 16 to lift fabric items contained in the drum 16 while the drum 16 rotates, as is well known in the washing machine art. A motor 22 coupled to the drum 16 through a belt 24 and a drive shaft 25 may rotate the drum 16. Alternately, the motor 22 may be directly coupled with the drive shaft 25 as is known in the art. Both the tub 14 and the drum 16 may be selectively closed by a door 26. A bellows 27 couples an open face of the tub 14 with the cabinet 12, and the door 26 seals against the bellows 27 when the door 26 closes the tub 14. The drum 16 may define a cleaning chamber 28 for receiving fabric items to be cleaned.

The tub 14 and/or the drum 16 may be considered a receptacle, and the receptacle may define a treatment chamber for receiving fabric items to be treated. While the illustrated washing machine 10 includes both the tub 14 and the drum 16, it is within the scope of the invention for the fabric treatment appliance to include only one receptacle, with the receptacle defining the treatment chamber for receiving the fabric items to be treated.

Washing machines are typically categorized as either a vertical axis washing machine or a horizontal axis washing machine. As used herein, the "vertical axis" washing machine refers to a washing machine having a rotatable drum that rotates about a generally vertical axis, relative to a surface that supports the washing machine. Typically the drum is perforate or imperforate, and holds fabric items and a fabric moving element, such as an agitator, impeller, nutator, and the like, that induces movement of the fabric items to impart mechanical energy to the fabric articles for cleaning action. However, the rotational axis need not be vertical. The drum can rotate about an axis inclined relative to the vertical axis. As used herein, the "horizontal axis" washing machine refers to a washing machine having a rotatable drum that rotates about a generally horizontal axis relative to a surface that supports the washing machine. The drum may be perforated or imperforate, and holds fabric items and typically washes the fabric items by the fabric items rubbing against one another and/or hitting the surface of the drum as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element moves within a drum to impart mechanical energy directly to the clothes or indirectly through wash liquid in the drum. The clothes mover is typically moved in a reciprocating rotational movement. In horizontal axis machines mechanical energy is imparted to the clothes by the tumbling action formed by the repeated lifting and dropping of the clothes, which is typically implemented by the rotating drum. The illustrated exemplary washing machine of FIGS. 1 and 2 is a horizontal axis washing machine.

With continued reference to FIG. 2, the motor 22 may rotate the drum 16 at various speeds in opposite rotational directions. In particular, the motor 22 may rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 may be facilitated by the baffles 20. Typically, the radial force applied to the fabric items at the tumbling speeds may be less than about 1 G. Alternatively, the motor 22 may rotate the drum 16 at spin speeds wherein the fabric items rotate with the drum 16 without falling. In the washing machine art, the spin speeds may also be referred to as satellizing speeds or sticking speeds. Typically, the force applied to the fabric items at the spin speeds may be greater than or about equal to 1 G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The washing machine 10 of FIG. 2 may further include a liquid supply and recirculation system. Liquid, such as water, may be supplied to the washing machine 10 from a water supply 29, such as a household water supply. A first supply conduit 30 may fluidly couple the water supply 29 to a detergent dispenser 32. An inlet valve 34 may control flow of the liquid from the water supply 29 and through the first supply conduit 30 to the detergent dispenser 32. The inlet valve 34 may be positioned in any suitable location between the water supply 29 and the detergent dispenser 32. A liquid conduit 36 may fluidly couple the detergent dispenser 32 with the tub 14. The liquid conduit 36 may couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 typically enters a space between the tub 14 and the drum 16 and may flow by gravity to a sump 38 formed in part by a lower portion 40 of the tub 14. The sump 38 may also be formed by a sump conduit 42 that may fluidly couple the lower portion 40 of the tub 14 to a pump 44. The pump 44 may direct fluid to a drain conduit 46, which may drain the liquid from the washing machine 10, or to a recirculation conduit 48, which may terminate at a recirculation inlet 50. The recirculation inlet 50 may direct the liquid from the recirculation conduit 48 into the drum 16. The recirculation inlet 50 may introduce the liquid into the drum 16 in any suitable manner, such as by spraying, dripping, or providing a steady flow of the liquid.

The exemplary washing machine 10 may further include a steam generation system. The steam generation system may include a steam generator 60 that may receive liquid from the water supply 29 through a second supply conduit 62, optionally via a reservoir 64. The inlet valve 34 may control flow of the liquid from the water supply 29 and through the second supply conduit 62 and the reservoir 64 to the steam generator 60. The inlet valve 34 may be positioned in any suitable location between the water supply 29 and the steam generator 60. A steam conduit 66 may fluidly couple the steam generator 60 to a steam inlet 68, which may introduce steam into the tub 14. The steam inlet 68 may couple with the tub 14 at any suitable location on the tub 14 and is shown as being coupled to a rear wall of the tub 14 in FIG. 2 for exemplary purposes. The steam that enters the tub 14 through the steam inlet 68 may subsequently enter the drum 16 through the perforations 18. Alternatively, the steam inlet 68 may be configured to introduce the steam directly into the drum 16. The steam inlet 68 may introduce the steam into the tub 14 in any suitable manner.

An optional sump heater 52 may be located in the sump 38. The sump heater 52 may be any type of heater and is illustrated as a resistive heating element for exemplary purposes. The sump heater 52 may be used alone or in combination with the steam generator 60 to add heat to the chamber 15. Typically, the sump heater 52 adds heat to the chamber 15 by heating water in the sump 38.

The washing machine 10 may further include an exhaust conduit (not shown) that may direct steam that leaves the tub 14 externally of the washing machine 10. The exhaust conduit may be configured to exhaust the steam directly to the exterior of the washing machine 10. Alternatively, the exhaust conduit may be configured to direct the steam through a condenser prior to leaving the washing machine 10. Examples of exhaust systems are disclosed in the following patent applications, which are incorporated herein by reference in their entirety: U.S. patent application Ser. No. 11/464,506, titled "Fabric Treating Appliance Utilizing Steam," U.S. patent application Ser. No. 11/464,501, titled "A Steam Fabric Treatment Appliance with Exhaust," U.S. patent application Ser. No. 11/464,521, titled "Steam Fabric Treatment Appliance with Anti-Siphoning," and U.S. patent application Ser. No. 11/464,520, titled "Determining Fabric Temperature in a Fabric Treating Appliance," all filed Aug. 15, 2006.

The steam generator 60 may be any type of device that converts the liquid to steam. For example, the steam generator 60 may be a tank-type steam generator that stores a volume of liquid and heats the volume of liquid to convert the liquid to steam. Alternatively, the steam generator 60 may be an in-line steam generator that converts the liquid to steam as the liquid flows through the steam generator 60. As another alternative, the steam generator 60 may utilize the sump heater 52 or other heating device located in the sump 38 to heat liquid in the sump 38. The steam generator 60 may produce pressurized or non-pressurized steam.

Exemplary steam generators are disclosed in U.S. patent application Ser. No. 11/464,528, titled "Removal of Scale and Sludge in a Steam Generator of a Fabric Treatment Appliance," U.S. patent application Ser. No. 11/450,836, titled "Prevention of Scale and Sludge in a Steam Generator of a Fabric Treatment Appliance," and U.S. patent application Ser. No. 11/450,714, titled "Draining Liquid From a Steam Generator of a Fabric Treatment Appliance," all filed Jun. 9, 2006, in addition to U.S. patent application Ser. No. 11/464,509, titled "Water Supply Control for a Steam Generator of a Fabric Treatment Appliance," U.S. patent application Ser. No. 11/464,514, now U.S. Pat. No. 7,591,859 titled "Water Supply Control for a Steam Generator of a Fabric Treatment Appliance Using a Weight Sensor," and U.S. patent application Ser. No. 11/464,513, titled "Water Supply Control for a Steam Generator of a Fabric Treatment Appliance Using a Temperature Sensor," all filed Aug. 15, 2006, which are incorporated herein by reference in their entirety.

In addition to producing steam, the steam generator 60, whether an in-line steam generator, a tank-type steam generator, or any other type of steam generator, may heat water to a temperature below a steam transformation temperature, whereby the steam generator 60 produces heated water. The heated water may be delivered to the tub 14 and/or drum 16 from the steam generator 60. The heated water may be used alone or may optionally mix with cold or warm water in the tub 14 and/or drum 16. Using the steam generator 60 to produce heated water may be useful when the steam generator 60 couples only with a cold water source of the water supply 29. Optionally, the steam generator 60 may be employed to simultaneously supply steam and heated water to the tub 14 and/or drum 16.

The liquid supply and recirculation system and the steam generation system may differ from the configuration shown in FIG. 2, such as by inclusion of other valves, conduits, wash aid dispensers, and the like, to control the flow of liquid and steam through the washing machine 10 and for the introduction of more than one type of detergent/wash aid. For example, a valve may be located in the liquid conduit 36, in the recirculation conduit 48, and in the steam conduit 66. Furthermore, an additional conduit may be included to couple the water supply 29 directly to the tub 14 or the drum 16 so that the liquid provided to the tub 14 or the drum 16 does not have to pass through the detergent dispenser 32. Alternatively, the liquid may be provided to the tub 14 or the drum 16 through the steam generator 60 rather than through the detergent dispenser 32 or the additional conduit. As another example, the liquid conduit 36 may be configured to supply liquid directly into the drum 16, and the recirculation conduit 48 may be coupled to the liquid conduit 36 so that the recirculated liquid enters the tub 14 or the drum 16 at the same location where the liquid from the detergent dispenser 32 enters the tub 14 or the drum 16.

Other alternatives for the liquid supply and recirculation system are disclosed in U.S. patent application Ser. No. 11/450,636, now U.S. Pat. No. 7,627,920 titled "Method of Operating a Washing Machine Using Steam;" U.S. patent application Ser. No. 11/450,529, titled "Steam Washing Machine Operation Method Having Dual Speed Spin Pre-Wash;" and U.S. patent application Ser. No. 11/450,620, titled "Steam Washing Machine Operation Method Having Dry Spin Pre-Wash," all filed Jun. 9, 2006, which are incorporated herein by reference in their entirety.

Figure 3:
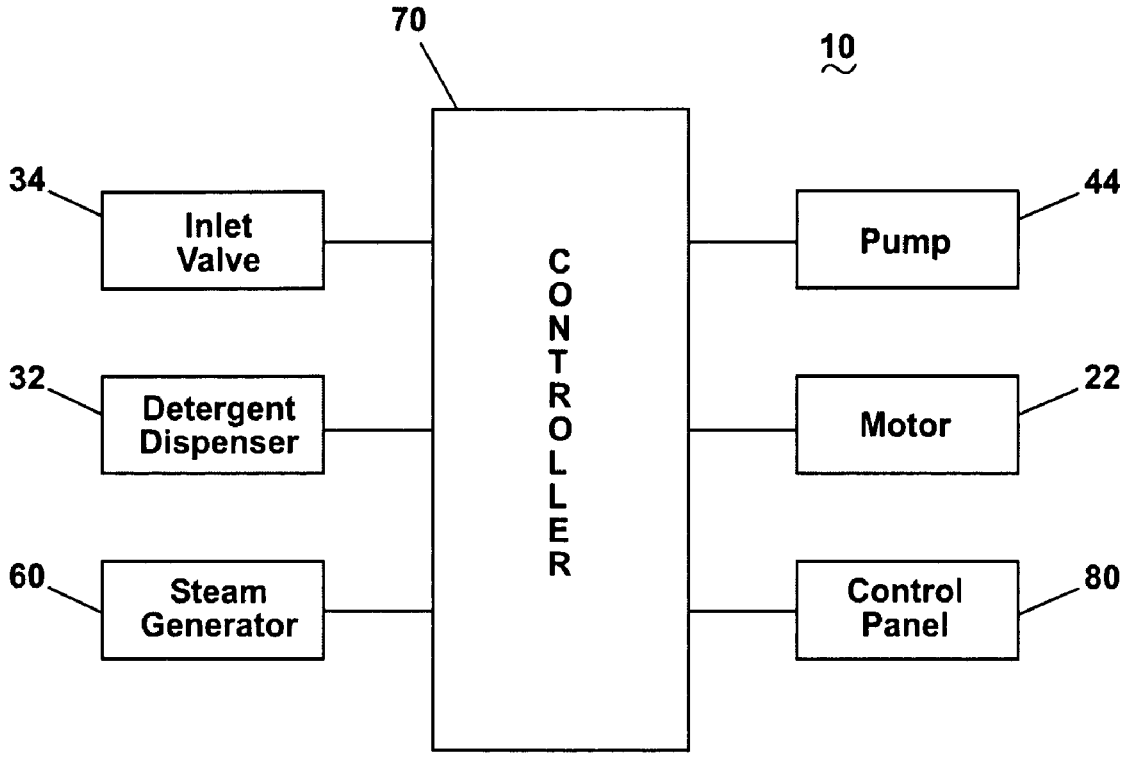
FIG. 3 is a schematic view of an exemplary control system of the fabric treatment appliance of FIG. 1.

Referring now to FIG. 3, which is a schematic view of an exemplary control system of the washing machine 10, the washing machine 10 may further include a controller 70 coupled to various working components of the washing machine 10, such as the pump 44, the motor 22, the inlet valve 34, the detergent dispenser 32, and the steam generator 60, to control the operation of the washing machine 10. If the optional sump heater 52 is used, the controller may also control the operation of the sump heater 52. The controller 70 may receive data from one or more of the working components and may provide commands, which can be based on the received data, to one or more of the working components to execute a desired operation of the washing machine 10. The commands may be data and/or an electrical signal without data. A control panel 80 may be coupled to the controller 70 and may provide for input/output to/from the controller 70. In other words, the control panel 80 may perform a user interface function through which a user may enter input related to the operation of the washing machine 10, such as selection and/or modification of an operation cycle of the washing machine 10, and receive output related to the operation of the washing machine 10.

Many known types of controllers may be used for the controller 70. The specific type of controller is not germane to the invention. It is contemplated that the controller is a microprocessor-based controller that implements control software and sends/receives one or more electrical signals to/from each of the various components (inlet valve 34, detergent dispenser 32, steam generator 60, pump 44, motor 22, and control panel 80) to effect the control software.

Figure 4:
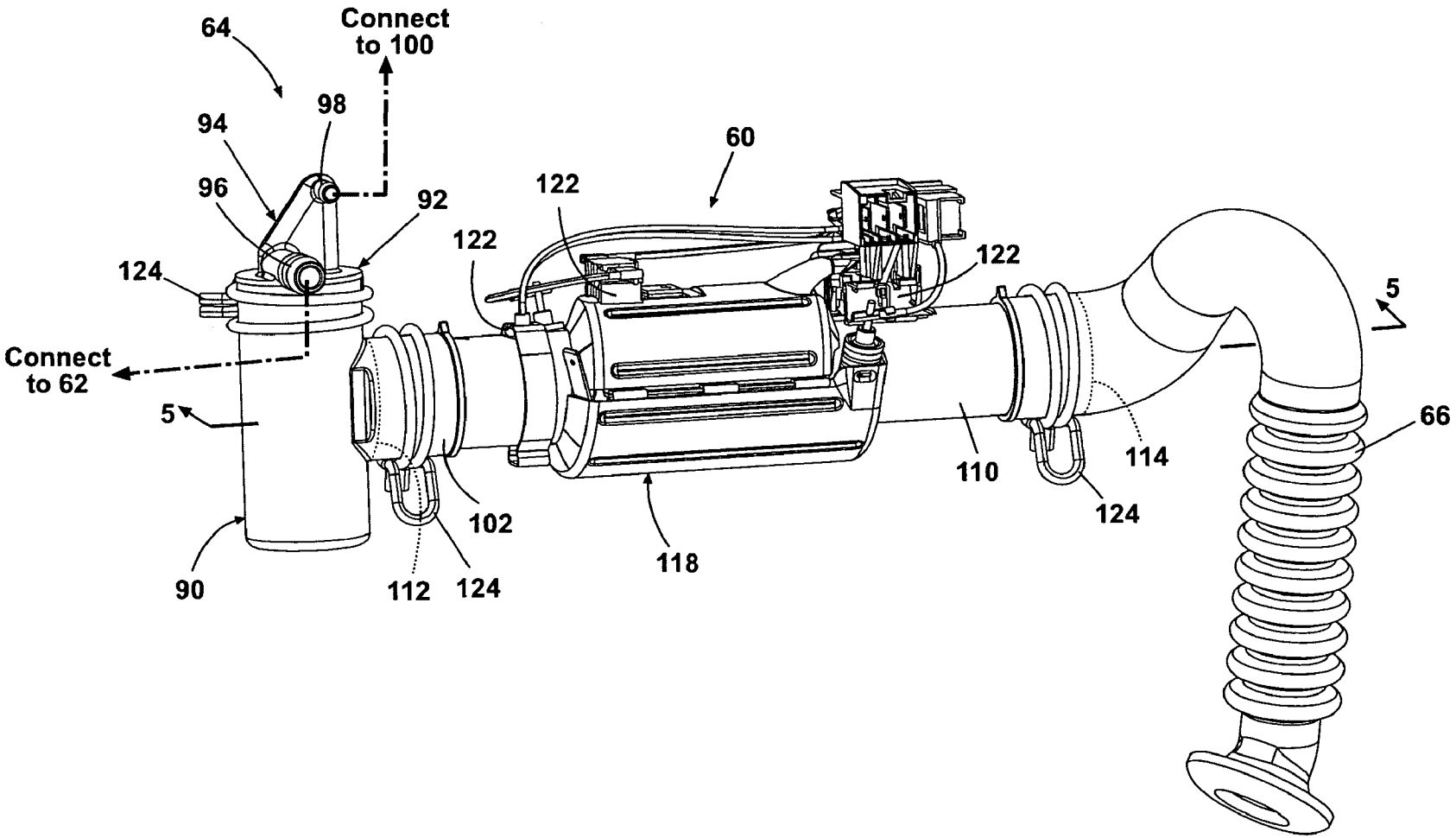
FIG. 4 is a perspective view of a steam generator from the fabric treatment appliance of FIG. 1.
Figure 5:
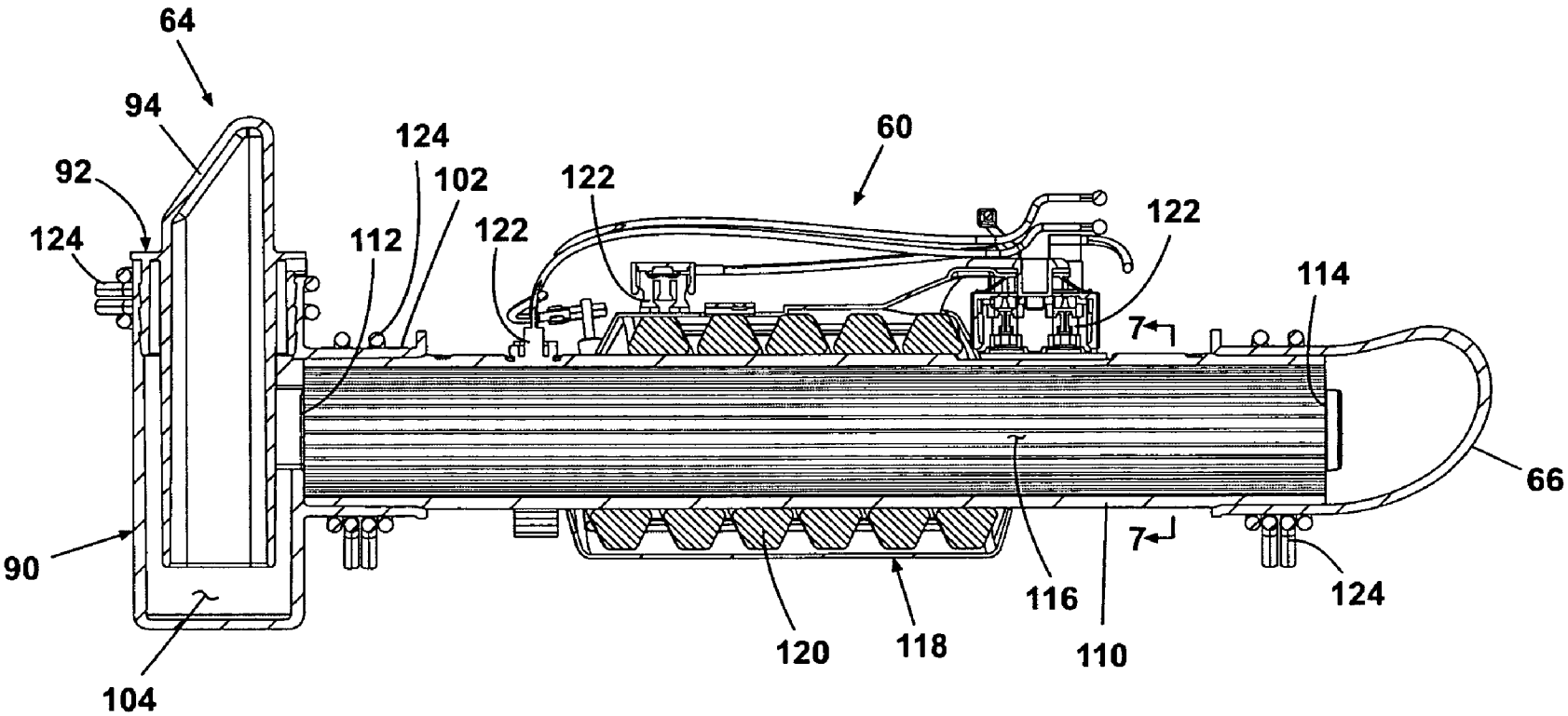
FIG. 5 is a sectional view taken along line 5-5 of FIG. 4.

FIG. 4 provides a perspective view of the reservoir 64, the steam generator 60, and the steam conduit 66. In general, the reservoir 64 may be configured to receive water from the water supply 29, store a volume of water, and supply water to the steam generator 60. In the exemplary embodiment, the reservoir 64 may include an open-top tank 90 and a lid 92 removably closing the open top of the tank 90. The reservoir 64 may include a water supply conduit 94 for supplying water from the water supply 29 to the tank 90. In the illustrated embodiment, the water supply conduit 94 may extend through the lid 92 and include a water supply inlet connector 96 and a siphon break connector 98. The water supply inlet connector 96 may be coupled to the second water supply conduit 62 (FIG. 2) to receive water from the water supply 29 and provide the water to the water supply conduit 94. The siphon break connector 98 may be coupled to a siphon break conduit 100 (FIG. 2) to form a siphon break device. The siphon break conduit 100 may be coupled to atmosphere external to the washing machine 10. The water supply inlet connector 96, the siphon break connector 98, and the water supply conduit 94 may be in fluid communication with one another. The reservoir 64 may further include a steam generator connector 102 for coupling the tank 90 to the steam generator 60 and supplying water from the tank 90 to the steam generator 60. In the illustrated embodiment, the steam generator connector 102 may project laterally from the tank 90. As seen in FIG. 5, which is a sectional view of the reservoir 64, the steam generator 60, and the steam conduit 66, the steam generator connector 102 fluidly communicates the steam generator 60 with an interior or chamber 104 of the tank 90.

With continued reference to FIG. 5, while the steam generator 60 can be any type of steam generator, the exemplary steam generator 60 of the current embodiment is in the form of an in-line steam generator with a tube 110 having a first end 112 coupled to the steam generator connector 102 of the reservoir 64 and a second end 114 coupled to the steam conduit 66. The tube 110 may define a steam generation chamber 116 between the first end 112 and the second end 114, which may defined an inlet and an outlet, respectively, of the steam generator 60. A heat source 118 may be positioned relative to the tube 110 and the steam generation chamber 116 to provide heat to the tube 110 and the steam generation chamber 116. In the current embodiment, the heat source 118 includes a resistive heater 120 coiled around the tube 110 in a generally central location relative to the first and second ends 112, 114. The steam generator 60 may have temperature sensors 122 associated with the tube 110 and/or the heat source 118 and in communication with the controller 70 for operation of the heat source 118 and/or supply of water to the steam generator 60. Clamps 124 may be employed to secure the steam generator tube 110 to the steam generator connector 102 of the reservoir 64 and to the steam conduit 66 and to secure the reservoir lid 92 to the tank 90.

The steam generator 60 may be employed for steam generation during operation of the washing machine 10, such as during a wash operation cycle, which can include prewash, wash, rinse, and spin steps, during a washing machine cleaning operation cycle to remove or reduce biofilm and other undesirable substances, like microbial bacteria and fungi, from the washing machine, during a refresh or dewrinkle operation cycle, or during any other type of operation cycle. The steam generator may also be employed for generating heated water during operation of the washing machine 10.

The steam generator 60 may also be employed to clean itself. The cleaning of the steam generator 60 may prevent formation of or reduce deposits and may remove deposits already formed in the steam generator 10. The cleaning operation may be performed before, during, and/or after an operation cycle of the washing machine 10 and may be performed as a stand-alone process separate from an operation cycle of the washing machine 10. The cleaning operation may be selected manually by a user, such as through the control panel 80, may be performed automatically according to a programmed operational cycle, periodically at predetermined times, and/or in response to a predetermined condition, such as upon sensing formation of a predetermined amount of deposits in the steam generator 60, or upon a predetermined number of wash cycles occurring. An exemplary cleaning operation of the steam generator 60 is provided below.

Figure 6:
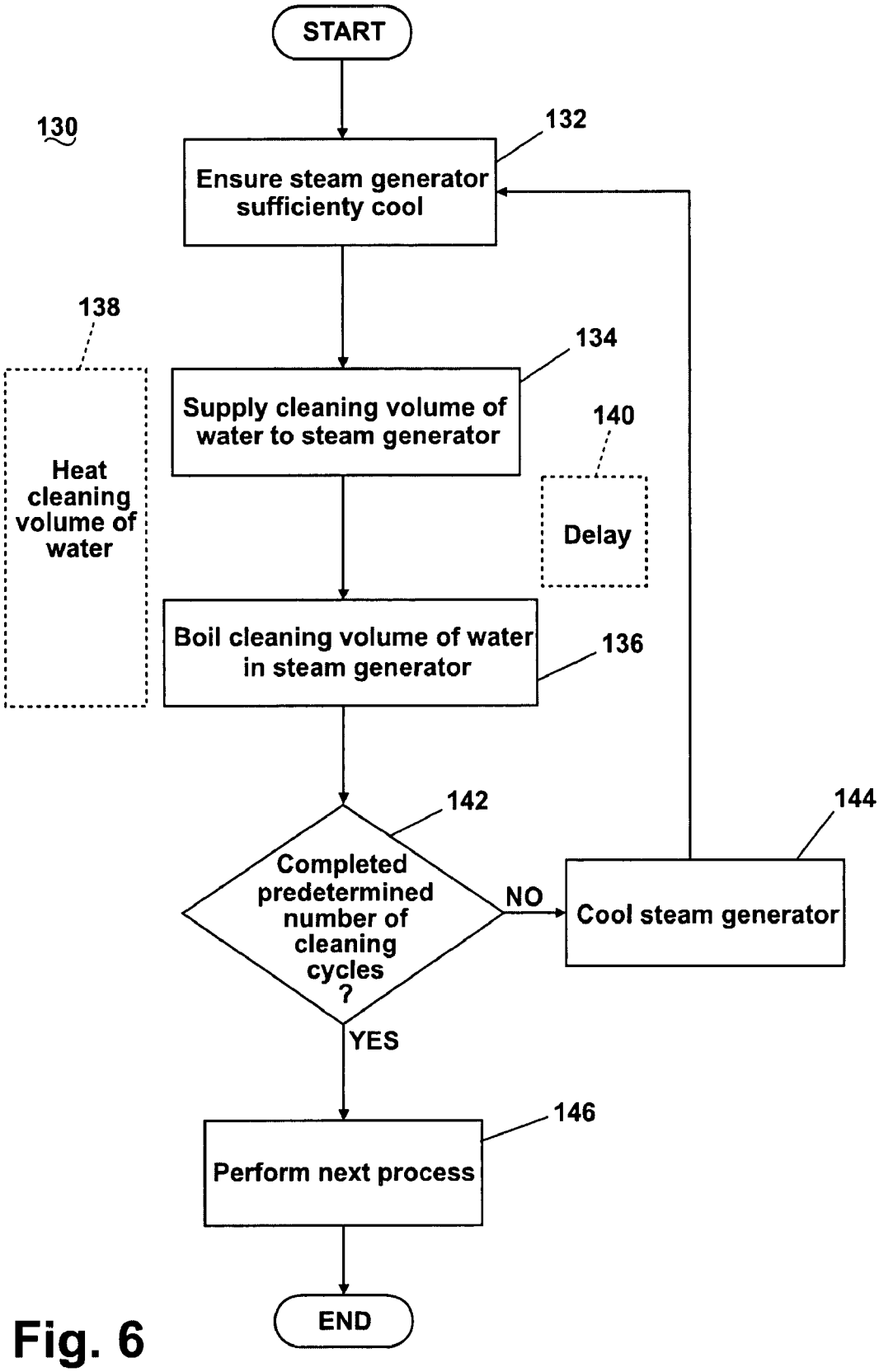
FIG. 6 is a flow chart of an exemplary method of cleaning the steam generator in the fabric treatment appliance of FIG. 1 according to one embodiment of the invention.

FIG. 6 is a flow chart of an exemplary method 130 of cleaning the steam generator in the fabric treatment appliance of FIG. 1 according to one embodiment of the invention. The cleaning method 130 may begin with an optional step 132 of ensuring that the steam generator 60 is sufficiently cool. If the steam generator 60 has been inoperative for a while prior to conducting the cleaning method 130, then the steam generator 60 is likely to be sufficiently cool, and the cleaning method 130 may proceed. On the other hand, if the steam generator 60 has been recently operative prior to conducting the cleaning method 130, then the steam generator 60 may not be sufficiently cool, and the cleaning method 130 may not proceed until it has been determined that the steam generator 60 is sufficiently cool. The temperature of the steam generator 60 may be monitored in any suitable manner for the optional step 132, such as by one or more of the temperature sensors 122. The purpose of the optional step 132 and the sufficiently cool condition of the steam generator 60 will be explained in more detail below.

Following or during the optional step 132, if performed, the cleaning method 130 proceeds to a step 134 of supplying a cleaning volume of water to the steam generator 60. In the exemplary embodiment in the figures, water from the water supply 29 may be provided to the steam generator 60 via the valve 34, the second supply conduit 62, the water supply conduit 94, the tank 90, and the steam generator connector 102. In other embodiments, a second water supply line (not shown) having a different flow rate, such as a flow rate greater than a flow rate through the water supply line used to provide water for steam generation, may be plumbed to and provide a cleaning volume of water to the steam generator 60. The cleaning volume of water supplied to the steam generator 60 in the step 134 may be greater than an operational volume of the steam generator 60. The operational volume of the steam generator 60 may correspond to a volume of water provided to the steam generator 60 when the steam generator 60 is utilized to generate steam, such as during an operational cycle of the washing machine 10.

The cleaning volume of water and the operational volume of water may be a function of the characteristics of the particular steam generator. An operational understanding of the particular steam generator is useful in understanding these volumes. For an in-line steam generator, depending on the volume of supplied water and the temperature of the steam generator, the output from the steam generator may be steam only, water only, or a combination of steam and water. A ratio of water output from the steam generator to water converted to steam depends on the amount of water supplied to or present in the steam generator; as the amount of water in the steam generator increases, the ratio increases (i.e., an increasing percentage of the water input to the steam generator leaves as water rather than steam).

Test data showing this behavior for a steam generator having an internal volume of about 175 mL and using a 1000 watt heater at 120 volts are provided in following table. The heater has variable thermal output with 250 watts being applied to approximately the top half of the tube 110 and 750 watts being applied to approximately the bottom half of the tube, which is more directed to the water. Thus, more of the thermal output of the heater is conducted into the water. Such a variable thermal output heater is disclosed in the contemporaneously filed U.S. patent application entitled "Fabric Treatment Appliance with Variable Thermal Output Heating Element" bearing the reference number 71354-575/US20070339, now U.S. patent application Ser. No. 11/848,550 the description of which is incorporated by reference in its entirety. While the data in the table relates to a variable thermal output heating element, the current invention is not so limited, and the type of heating element is not germane to the current invention. Traditional heating elements, including those with a non-variable thermal output can be used.

In the table:

Water Input is the volume of water present in the steam generator,

% Full is a measure of the volume of water present in the steam generator compared to the internal volume of the steam generator, Water Output is the volume of water output from the steam generator (i.e., the amount of water leaving the steam generator), % Output is a measure of the volume of water output from the steam generator compared to the volume of water present in the steam generator, Difference is the difference between Water Input and Water Output, which estimates amount of water converted to steam, assuming no other water losses, and Ratio is a ratio of Water Output to Difference (i.e., the ratio of water output from the steam generator to water converted to steam).

| Water Input (mL) | % Full | Water Output (mL) | % Output | Difference (mL) | Ratio |
|---|---|---|---|---|---|
| 59.56 | 34.04% | 0 | 0% | 59.56 | 0 |
| 59.92 | 34.24% | 0 | 0% | 59.92 | 0 |
| 69.55 | 39.74% | 0 | 0% | 69.55 | 0 |
| 71.33 | 40.76% | 7 | 9.81% | 64.33 | 0.1088 |
| 73.12 | 41.78% | 3 | 4.10% | 70.12 | 0.0428 |
| 73.83 | 42.19% | 5 | 6.77% | 68.83 | 0.0726 |
| 74.90 | 42.80% | 6 | 8.01% | 68.90 | 0.0871 |
| 77.40 | 44.23% | 11 | 14.21% | 66.40 | 0.1657 |
| 84.17 | 48.10% | 15 | 17.82% | 69.17 | 0.2168 |
| 111.64 | 63.79% | 39 | 34.93% | 72.64 | 0.5369 |
| 115.92 | 66.24% | 42 | 36.23% | 73.92 | 0.5682 |
| 119.13 | 68.07% | 47 | 39.45% | 72.13 | 0.6516 |

-continued

| Water Input (mL) | % Full | Water Output (mL) | % Output | Difference (mL) | Ratio |
|---|---|---|---|---|---|

To convert 100% of the inputted water to steam, smaller amounts of water need to be supplied. Practical reasons, such as production costs and resource efficiency, tend to cause the steam generator to be operated such that it supplies both water and steam when making steam. Practical reasons, such as time to generate steam from the supplied water, also tend to cause the inputted water level to be less than the internal volume of the steam generator.

Thus, for the cleaning method 130, the operational volume of water may correspond to a volume of water provided to the steam generator 60 when the steam generator 60 is utilized to generate steam, which may be a volume of water that yields a desired ratio of water output from the steam generator to water converted to steam. In one embodiment, the operational volume of water may be a volume of water that yields more water converted to steam than water output from the steam generation, i.e., a ratio less than about 0.5. As an example, the operational volume of water may a volume in a range of about 5% to 50% of an internal volume of the steam generator 60.

It is worth noting that the percentages are practical percentages, not theoretical limits, and are a function of the structure of the illustrated steam generator. Different steam generators may have different practical ranges. For example, operational volumes above 50% may be used. However, because the heater for the steam generator has a limited rate of heating, additional water beyond the point where the water can be converted to steam will not result in more steam but will result in more water being passed through the steam generator. Additional water can also lead to less steam production because of the cooling effect of the additional water. If a greater wattage heater was used or the thermal conductivity was increased, greater volumes of water could be converted into steam instead of passing through the steam generator. Also, while volumes below 5% will be suitable for some steam generators, in the illustrated example, the operational volume of water less than about 5% of the internal volume of the steam generator may not produce a practical amount of steam or steam at a desired flow rate.

The cleaning volume of water may for practical considerations correspond to a volume of water sufficient to clean the steam generator 60, which may be a volume of 15 water that yields more water output from the steam generator than water converted to steam, i.e., a ratio greater than about 0.5. As an example, the cleaning volume of water may be a volume corresponding in a range of about 60% to 100% of an internal volume of the steam generator 60. However, it should be noted that the steam generator may be operated at much lower ratios than 0.5 and still provide some cleaning. Cleaning 20 will take place at ratios approaching zero. The practical ratio ranges described herein are related to the particular structure of the steam generator and with an eye towards minimizing resource usage and are not theoretical limits. The exemplary ranges for the cleaning volume of water and the operational volume of water are provided for illustrative purposes and may vary depending on the type and structure of the steam 25 generator 60. For example, for the steam generator 60 of FIGS. 4 and 5, the internal volume of the steam generator 60 may be determined by including the volume of the tank 90 and a portion of the volume of the steam conduit 66 with the volume of the steam generation chamber 116. Alternatively, the internal volume of the steam generator 60 may be determined by only using the volume of the steam generation chamber 116. Other types and constructions of the steam generator 60 may not include the reservoir 64 and may include other structures in conjunction with the steam generator 60 that may be used for determining the internal volume of the steam generator 60.

To prevent water supplied to the steam generator 60 from flowing directly out of the steam generator 60 to the tub 14, the steam conduit 66 of the illustrated embodiment has a gooseneck portion 67 that transitions into an articulated portion 69. The gooseneck portion 67 extends above the second end 114 of the steam generator tube 110 and aids in retarding the immediate passing of water out of the steam generator tube 110 upon filling. The articulated portion 69 provides for axial extension/contraction for ease of coupling the steam generator 60 to the tub 14.

Referring again to FIG. 6, the cleaning method 130 proceeds with a step 136 of boiling the cleaning volume of water in the steam generator 60. In the exemplary embodiment, the boiling of the cleaning volume of water may be accomplished by heating the cleaning volume of water with the heat source 118, but it is within the scope of the invention to accomplish the boiling in any suitable manner. A box 138 in FIG. 6 represents the heating of the cleaning volume of water to accomplish the boiling. The heating may initiate at any suitable time during the cleaning method 130, such as at the beginning of, during, or after the step 134 of supplying the cleaning volume of water. It is also contemplated that the heating may begin prior to the step 134 of supplying the cleaning volume of water should preheating the steam generator 60 be employed in an embodiment that does not employ the optional step 132 of ensuring the steam generator 60 is sufficiently cool. The heating may cease at any desired time after the boiling of the cleaning volume of water begins and may continue until the end of the boiling of the cleaning volume of water. In one example, the heating may continue until the cleaning volume of water reduces via evaporation and expulsion, which will be described below, to a predetermined volume, such as a volume about equal to the operational volume of water.

Optionally, the cleaning method may include a delay, indicated by a box 140 in FIG. 6, between the supplying of the cleaning volume of water and the boiling of the cleaning volume of water. During the delay, some of the cleaning volume of water may seep into or otherwise fill any interstitial spaces in deposits formed along the interior of the steam generator tube 110. The heating of the cleaning volume of water may occur during the delay or may begin after the delay.

The interstitial spaces may include fissures in the deposits as well as spaces in the crystalline structure of the deposits. In the crystalline structure, groupings of crystals may form adjacent to other groupings of crystals having different orientations. While each grouping will often have an internally uniform crystalline matrix, the matrices of adjacent groupings are not always uniform, resulting in interstitial spaces formed at the interface of the adjacent groupings. Thus, the interstitial spaces may be on a macroscopic level (i.e., visible with the eye) or a microscopic level (i.e., visible with only a microscope or other magnifying tool).

During the boiling of the cleaning volume of water, a portion of the cleaning volume of water undergoes a phase transformation and converts to steam. In the exemplary embodiment, the heat source 118 heats the steam generator tube 110 whereby heat flows radially inward into the steam generation chamber 116. The conversion of water to steam creates rapidly expanding steam bubbles generated at the interstitial spaces and at the interior surface of the steam generator tube 110. The rapidly expanding bubbles can cause at least some of the deposit and/or at least some of the crystal groupings to separate from the remainder of the deposit or the steam generation chamber 116. The steam bubbles also create turbulence in the cleaning volume of water, and the turbulence forces some of the cleaning volume of water out of the steam generation chamber 116 toward the steam conduit 66 carrying at least some of separated deposits out of the steam generator 60 to thereby clean the steam generator 60. In the exemplary embodiment, the expelled water, along with the expelled deposits, flows through the steam conduit 66 to the tub 14 for collection in the sump 38 without entering the drum 16, thereby avoiding contamination of any fabric or other items located in the drum 16. However, the expelled water and steam could be directed by suitable plumbing directly to a drain or drain pump.

As the steps 134 and 136 of supplying the cleaning volume of water and boiling the cleaning volume of water have been described, advantages of the above-described optional step 132 of ensuring that the steam generator 60 is sufficiently cool may be explained. Supplying water to the steam generator 60 in a sufficiently cool condition may avoid relatively large production of scale on the interior of the steam generator tube 110 because adding water to a hot chamber typically results in sudden expansion of the water and scale formation. Further, immediate formation of steam from the water being added to the steam generator when the steam generator is sufficiently heated to induce the phase transformation may not allow the cleaning volume of water to fully enter the steam generator 60 or fill any interstitial spaces in the deposits. Ensuring that the steam generator 60 is sufficiently cool prior to the supplying of the cleaning volume of water may avoid such problems.

After completion of the boiling of the volume of water, which may be determined by time or another variable, such as the cleaning volume of water reducing via evaporation and expulsion to a predetermined volume, e.g., a volume about equal to the operational volume of water, the cleaning method 130 determines in a step 142 whether a predetermined number of cleaning cycles have been completed. The cleaning cycle may include at least the supplying of the cleaning volume of water and the boiling of the cleaning volume of water and may further include other steps, such as the ensuring of the sufficiently cool steam generator 60, the heating, and the delay. The cleaning cycle may be performed once or more than once in a repeating manner to further clean the steam generator 60.

If the predetermined number of cleaning cycles has not been completed, then the cleaning method 130 may return to the step 134 via an optional step 144 of cooling the steam generator 60 and the optional step 132 of ensuring the steam generator 60 is sufficiently cool. The step 144 of cooling the steam generator 60 may include any suitable action, including passive actions, such as waiting a predetermined time, waiting until the temperature of the steam generator 60 has decreased to a predetermined temperature, active actions, such as supplying cool or cold water to the steam generator 60 to decrease the temperature of the steam generator 60, or combinations thereof. If the cooling step 144 is not performed, the cleaning method 130 may proceed directly to the step 134 of supplying the cleaning volume of water, in which case, the heating from the preceding cleaning cycle may optionally continue without interruption between the cleaning cycles.

If the predetermined number of cleaning cycles has been completed, then the cleaning method proceeds to a next process in a step 146, which can be a process separate from the cleaning method 130 or part of the cleaning method 130. For example, processes separate from the cleaning method 130 may include, but are not limited to, supplying the operational volume of water to the steam generator 60 for a steam generation process and supplying a volume of water to the steam generator 60 for a heated water generation process. The cleaning method 130 may be repeated following the next process if desired. As an example, the cleaning process 130 may be performed prior to a steam generation process for an operational cycle of the washing machine 10 and after the steam generation process is complete.

Exemplary processes that may be considered part of the cleaning method may include, but are not limited to, heating to evaporate water remaining in the steam generator 60 after the boiling of the cleaning volume of water and flushing the steam generator 60 with water for further cleaning. The process of heating to evaporate the water remaining in the steam generator 60 may prevent further formation of scale or sludge resulting from residual water in the steam generator 60 and may reduce corrosion resulting from residual water in the steam generator 60 because the heating effectively dehydrates the steam generator 60.

The cleaning method 130 may be performed for any compatible steam generator and is not limited to use with the steam generator 60 shown in the figures and described above. Further, the reservoir 64 is optional and not necessary for performing the cleaning method 130.

Figure 7:
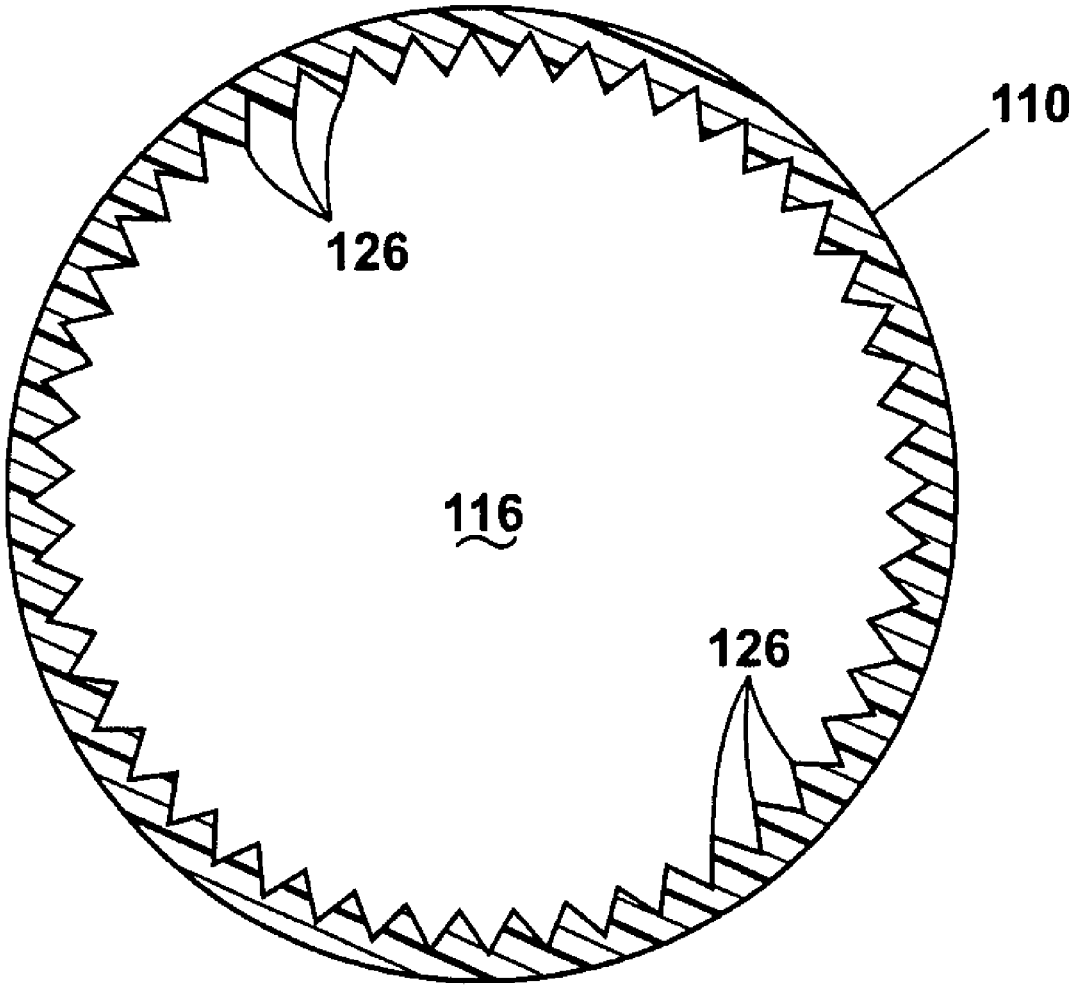
FIG. 7 is a sectional view taken along FIG. 7-7 of FIG. 5.

Referring to FIG. 7, while the interior surface of the tube 110 for the steam generator 60 may have any texture or shape, it has been found that irregular surfaces better promote the formation of deposits having many groupings with non-uniform crystalline structures, which create more interstitial spaces, leading to better deposit removal performance. FIG. 7 illustrates one known irregular surface structure or texture that promotes the formation of deposits with more grouping with a non-uniform crystalline structure as compared to a regular surface or surface without the structure or texture. The inner surface of the tube 110 is formed by multiple ridges 126. As illustrated, the ridges 126 are triangular in cross section and extend axially through the tube 110. Other cross sections are possible. The ridges 126 need not also extend axially. They could, for example, spiral around the tube 110 like rifling in a gun barrel. They can be continuous or discrete.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for operating a fabric treatment appliance having a receptacle defining a treatment chamber and for cleaning deposits from a steam generator having a steam generation chamber with an inlet for receiving water and an outlet for expelling steam, and a heat source for heating water in the steam generation chamber, the method comprising:

supplying a volume of water to the steam generation chamber greater than or equal to an operational volume of the steam generation chamber;

letting the water seep into interstitial spaces of deposits in the steam generation chamber; and heating the water to boil the water that has seeped into the interstitial spaces to separate at least some of the deposits from the steam generator and to effect the expulsion of steam, water, and at least some of the separated deposits through the outlet, until any remaining water is evaporated.

2. The method according to claim 1 wherein the supplying step comprises supplying a volume of water greater than an operational volume of water.

3. The method according to claim 2 wherein the operational volume of water is about 5-50% of the internal volume of the steam generator.

4. The method according to claim 1, further comprising supplying water to the steam generator, generating steam from the water in the steam generator, and supplying the generated steam to the treatment chamber during at least one of a prewashing, washing, rinsing, and spinning operation of the fabric treatment appliance.

5. The method according to claim 4, further comprising repeating the cleaning of deposits from the steam generator after the supplying of the generated steam.

6. The method according to claim 1, further comprising supplying water to the steam generator, generating heated water from the water in the steam generator, and supplying the heated water to the treatment chamber during at least one of a prewashing, washing, rinsing, and spinning operation of the fabric treatment appliance.

7. The method according to claim 1, further comprising actively cooling the steam generator.

8. The method according to claim 7, wherein the active cooling comprises supplying water at a temperature less than the boiling point of water to the steam generator.

9. The method according to claim 7, further comprising repeating the cleaning of the deposits from the steam generator a predetermined number of times.

10. The method according to claim 9, further comprising cooling the steam generator between the repeated cleanings of the deposits from the steam generator.

11. The method according to claim 1 wherein the cleaning of the deposits from the steam generator is performed after detection of a predetermined amount of deposits in the steam generator.

12. The method according to claim 1, further comprising flushing the steam generator with water for further cleaning after the initiating of the heating of the water.

13. A method for operating a fabric treatment appliance having a receptacle defining a treatment chamber and for cleaning deposits from a steam generator, the method comprising:

providing an in-line steam generator comprising a tube having an inlet for receiving water and an outlet for expelling steam, with a heat source adjacent the tube for heating the water in the tube to generate steam;

supplying a volume of water to the steam generation chamber greater than an operational volume of water;

letting the water seep into interstitial spaces of deposits in the tube; and boiling the water that seeped into the interstitial spaces to separate at least some of the deposits from the steam generator and to effect the expulsion of steam, water, and at least some of the separated deposits through the outlet, until any remaining water is evaporated.

14. The method according to claim 13, further comprising heating the volume of water during the supplying of the volume of the water.

15. The method according to claim 14 wherein the heating of the volume of water continues during the boiling of the volume of water.

16. The method according to claim 13 wherein the volume of water is about 60-100% of an internal volume of the steam generator.

17. The method according to claim 16 wherein the operational volume of water is about 5-50% of the internal volume of the steam generator.

18. The method according to claim 13, further comprising ensuring the steam generator is cool prior to the supplying of the volume of water.

19. The method according to claim 13, further comprising supplying an operational volume of water to the steam generator and generating steam from the operational volume of water.

20. The method according to claim 13, further comprising actively cooling the steam generator.

21. The method according to claim 20, wherein the active cooling comprises supplying water at a temperature less than the boiling point of water to the steam generator.

22. The method according to claim 20, further comprising repeating the supplying of the volume of water and the boiling of the volume of water a predetermined number of times.

23. The method according to claim 22, further comprising repeating the cooling of the steam generator between repeating the supplying of the volume of water and the boiling of the volume of water.

24. The method according to claim 13, further comprising flushing the steam generator with water for further cleaning after the initiating of the boiling of the water.

25. The method according to claim 13 wherein the volume of water is about 60-100% of an internal volume of the steam generator.

* * * * *

UNITED STATES PATENT AND TRADEMARK OFFICE

CERTIFICATE OF CORRECTION

PATENT NO. : 7,690,062 B2
APPLICATION NO. : 11/848540
DATED : April 6, 2010
INVENTOR(S) : Robert J. Pinkowski et al.

It is certified that error appears in the above-identified patent and that said Letters Patent is hereby corrected as shown below:

Claim 12: "The method according to claim 1, further comprising flushing the steam generator with water for further cleaning after the initiating of the heating of the water." -- should be Claim 12: "The method according to claim 1, further comprising flushing the steam generator with water for further cleaning after an initiating of the heating of the water."

Claim 13: "A method for operating a fabric treatment appliance having a receptacle defining a treatment chamber and for cleaning deposits from a steam generator, the method comprising: providing an in-line steam generator comprising a tube having an inlet for receiving water and an outlet for expelling steam, with a heat source adjacent the tube for heating the water in the tube to generate steam; supplying a volume of water to the steam generation chamber greater than an operational volume of water; letting the water seep into interstitial spaces of deposits in the tube; and boiling the water that seeped into the interstitial spaces to separate at least some of the deposits from the steam generator and to effect the expulsion of steam, water, and at least some of the separated deposits through the outlet, until any remaining water is evaporated." -- should be Claim 13: "A method for operating a fabric treatment appliance having a receptacle defining a treatment chamber and for cleaning deposits from a steam generator, the method comprising: providing an in-line steam generator comprising a tube having an inlet for receiving water and an outlet for expelling steam, with a heat source adjacent the tube for heating the water in the tube to generate steam; supplying a volume of water to the steam generator greater than an operational volume of water; letting the water seep into interstitial spaces of deposits in the tube; and boiling the water that seeped into the interstitial spaces to separate at least some of the deposits from the steam generator and to effect an expulsion of steam, water, and at least some of the separated deposits through the outlet, until any remaining water is evaporated."

Signed and Sealed this

Ninth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,690,062 B2
APPLICATION NO. : 11/848540
DATED : April 6, 2010
INVENTOR(S) : Robert J. Pinkowski et al.

It is certified that error appears in the above-identified patent and that said Letters Patent is hereby corrected as shown below:

Column 13, lines 37-39,
Claim 12: "The method according to claim 1, further comprising flushing the steam generator with water for further cleaning after the initiating of the heating of the water." -- should be Claim 12: "The method according to claim 1, further comprising flushing the steam generator with water for further cleaning after an initiating of the heating of the water."

Column 13, line 40 - Column 14, line 9,
Claim 13: "A method for operating a fabric treatment appliance having a receptacle defining a treatment chamber and for cleaning deposits from a steam generator, the method comprising: providing an in-line steam generator comprising a tube having an inlet for receiving water and an outlet for expelling steam, with a heat source adjacent the tube for heating the water in the tube to generate steam; supplying a volume of water to the steam generation chamber greater than an operational volume of water; letting the water seep into interstitial spaces of deposits in the tube; and boiling the water that seeped into the interstitial spaces to separate at least some of the deposits from the steam generator and to effect the expulsion of steam, water, and at least some of the separated deposits through the outlet, until any remaining water is evaporated." -- should be Claim 13: "A method for operating a fabric treatment appliance having a receptacle defining a treatment chamber and for cleaning deposits from a steam generator, the method comprising: providing an in-line steam generator comprising a tube having an inlet for receiving water and an outlet for expelling steam, with a heat source adjacent the tube for heating the water in the tube to generate steam; supplying a volume of water to the steam generator greater than an operational volume of water; letting the water seep into interstitial spaces of deposits in the tube; and boiling the water that seeped into the interstitial spaces to separate at least some of the deposits from the steam generator and to effect an expulsion of steam, water, and at least some of the separated deposits through the outlet, until any remaining water is evaporated."

This certificate supersedes the Certificate of Correction issued November 9, 2010.

Signed and Sealed this

Fourteenth Day of December, 2010

David J. Kappos

David J. Kappos
*Director of the United States Patent and Trademark Office*